US011365086B2

(12) United States Patent
Liu et al.

(10) Patent No.: US 11,365,086 B2
(45) Date of Patent: Jun. 21, 2022

(54) DEVICE USED TO RELEASE, RETRACT AND STORE A CABLE OR CABLE-LIKE STRUCTURE

(71) Applicants: Tian Li David Liu, Bloomington, CA (US); Jensen Siyuan Xi, Riverside, CA (US); Rui Li, Bloomington, CA (US)

(72) Inventors: Tian Li David Liu, Bloomington, CA (US); Jensen Siyuan Xi, Riverside, CA (US); Rui Li, Bloomington, CA (US)

( * ) Notice: Subject to any disclaimer, the term of this patent is extended or adjusted under 35 U.S.C. 154(b) by 375 days.

(21) Appl. No.: 16/680,257

(22) Filed: Nov. 11, 2019

(65) Prior Publication Data

US 2021/0139271 A1 May 13, 2021

(51) Int. Cl.
*B65H 75/16* (2006.01)
*B65H 75/44* (2006.01)
*B65H 75/48* (2006.01)

(52) U.S. Cl.
CPC ..... *B65H 75/4471* (2013.01); *B65H 75/16* (2013.01); *B65H 75/4402* (2013.01); *B65H 75/4418* (2013.01); *B65H 75/48* (2013.01); *B65H 2701/34* (2013.01)

(58) Field of Classification Search
CPC ..... B65H 75/16; B65H 75/40; B65H 75/48; B65H 75/364; B65H 75/4402; B65H 75/4421; B65H 75/4418; B65H 75/4471
See application file for complete search history.

(56) References Cited

U.S. PATENT DOCUMENTS

| | | | | |
|---|---|---|---|---|
| 10,587,944 | B2 * | 3/2020 | Yu | H04R 1/1033 |
| 2013/0315432 | A1 * | 11/2013 | Chen | H04R 1/1033 381/384 |
| 2018/0063622 | A1 * | 3/2018 | Song | H04R 1/1033 |
| 2019/0075386 | A1 * | 3/2019 | Yu | B65H 75/406 |

* cited by examiner

*Primary Examiner* — Sang K Kim

(57) ABSTRACT

A device used to release, retract, and store a cable or a cable-like structure that provides an easy solution for cable or cable-like structure applications. The device can be used for all kinds of electronic devices in private entities and public facilities tidily and safely. Applying the devices within the present patent application will significantly reduce safety hazards caused by ill-placed or tangled cables or cable-like structures while also storing said cables or cable-like structures when not in use.

12 Claims, 19 Drawing Sheets

DEVICE USED TO RELEASE, RETRACT AND STORE A CABLE OR CABLE-LIKE STRUCTURE

THE FIELD OF THE INVENTION

This invention relates to a device used to release, retract, and store a cable or a cable-like structure for safely and tidily using all kinds of electrical devices in private and public facilities, especially sterilized and dust-free conditions required by hospitals and laboratories.

BACKGROUND AND RELEVANT ART

Electrical devices, such as computers, printers, monitors, television, washing machine, refrigerator, microwave, telephones, the internet, and many others, are required various cables for power supply and data transfer in private and public facilities. The various removable and reusable cables do provide convenience for using various electrical devices. Because the length of a cable connector is a pre-designed with certain limited length range, such as 3, 5, 10, 15 or 25 ft or even longer, the extra cable or cable-like structures between the devices and power boards have therefore brought many problems. For example, the tangled extra cable or cable-like structures caused them to be much disorganized and mess up around the area near the wall power board or near the electrical devices. All these messed up and mixed extra cables or cable-like structures cause many problems for safety and tidy. Obviously, all messed up and exposed cable or cable-like structures are very serious safety hazards, such as causing a fire or electric shock, and very inconvenient for storing and reapplication. Especially for hospitals, laboratories and many other private or public facilities that require all equipment to be sterilized, cleaned, and better-controlled environments to avoid cross-infected, fire, even electrical shock.

U.S. Pat. No. 9,270,098 issued to Isaacks, et al, for "Cable laying configuration" in 2016, disclosed a Cable boxes and cable distribution systems securely store classifications. U.S. Pat. No. 7,514,628, issued to Kadrnoska, et al, for "Method and apparatus for routing cable in existing pipelines" in 2009, disclosed that at least one cable or cable-like structure which is to be laid, which can be unwound from a drum from the region of an opening providing access to an installation shaft or access shaft toward the respective pipe or channel, or drawn or fixed in a stationary manner in the pipe, channel or the like.

There are many products of cables boxes with many different designs used to keep various excess cables or cable-like structures. "Cable Box", for example, from Blue Lounge® designs and many other similar commercial products to cover or hide both the power connector and excess lines by keeping them in a box. All lines and plugs are still messy, with worse safety hazards inside the box. Zip ties or linked Zip ties are another ways used to maintain the extra cables or cable-like structures together. Still, there are some other ways to be used for the same purpose to keep all extra cable or cable-like structure to be tidy and safe. All messy and unsafe problems, related to cable or cable-like structure, seem never to be well or solved.

Therefore, it is the object of the present invention to provide a device that can be easily and safely used for all kind of cables or cable-like structures releasing, retracting and storing.

BRIEF SUMMARY OF THE INVENTION

Implementations of the present invention overcome one or more problems of extra cable or cable-like structure messing up and cause untidy and unsafe in using the cable or cable-like structure to supply power for various equipments, devices or link devices each other. In particular, the device provided herein includes the housing, the top and the bottom covers. The device allows the partial or the whole cable or cable-like structure to release or retract according to the requirement. In order to keep extra cable or cable-like structure to be tidily and safely placed inside the housing, the adjustable coiling tool is used to coil the cable or cable-like structure and further to place the coiled cable or cable-like structure into the housing. By adjusting the movable knurled thumb nut, which is linked with the sleeve-like locking frame by the movable controlling spring bracket, the adjustable coiling tool can be released from the well coiled cable and leave the coiled cable inside the housing tidily. For the purpose to keep all coiled cable to be orderly stay inside the housing, the various wire slots on the top end and the lower end of the housing will temporarily hold both ends of the cable, further to apply a stopper on each end and finally to seal the housing with top and bottom cover. The device provides a simple way to keep these cables with one plug or without plug to be tidy and safety in using, such as cable used in the washing machine, the refrigerator, the microwave, standing light and many others with one plug only.

In another embodiment, implementations of the present invention overcome one or more problems for those cables with pre-existing plugs on both ends, such as one male and one female plugs or both males or both females plugs or cable-like structures with pre-existing functional structures on both ends. The top and bottom covers comprise of a main part and a movable part to allow the cable with pre-existing plugs or the cable-like structure with pre-existing functional structure to using the device. The movable part of the top and bottom cover provide a way allow the cable with pre-existing plugs or the cable-like structure with pre-existing structures to enter the central hole. In order to orderly keep all retract cable inside the housing, the movable cable coiling frame is employed for this purpose. The movable cable coiling frame has different sized wire slots on the top end and bottom end so that one end of the cable can be inserted into the matched wire slots temporarily and further coiled cable onto the movable cable coiling frame. Upon finishing coiled the cable onto the movable cable coiling frame, the other end of the cable will be inserted to wire slot. The well coiled cable with the movable cable coiling frame is then placed onto the circle stepped protrusion of inside the housing. The pair of stoppers with various sized wire slot play an important role to keep retracted cable or cable-like structure to be orderly inside the housing. The various sized wire slots allow the cable or cable-like structure to be pulled out directly from the device according to the requirement for adjusting the length.

In more particular embodiments, the disclosures detail more different functional structures of the present device. The top cover and the bottom cover consist of a main part and a movable part. The two parts are joined to form an integrated cover by embedding the convex structures on the edges of the movable part into the recesses on the main part. The lock means in the device is used to limit the cable or cable-like structure in or out or staying inside the device. The adjustable nut in the lock means enables the device to fit for different diameter cable or cable-like structure to use the device. The plurality of directing bar make the cable or cable-like structure moving in or out the device to be more smoothly. The rotatably releasing, retracting and storing means (RRRS means) is the core part for cable or cable-like structure to be released, retracted or stored in the device. No matter if the cable or cable-like structure is in static and dynamic, the Regulator always guides the cable or cable-like structure to be orderly and tidily moved into or out from the device, since the protrusion of Regulator is embedded into the vertical directing groove on the inner wall and the Regulator can only move vertically along the groove. With the help of different directing bars, the cable or cable-like structure, in fact, is forcedly arrayed onto the rod with helix groove. The circular recess on the flange allows the whole RRRS means to be pivotally mounted on the movable ring which is pivoted on the circular recess of the circular protrusion on the lower portion of inner wall of the housing. Therefore, the circular recess on the flange, the circular recess on the circular protrusion and the sandwiching movable ring form a flange bearing and results the RRRS means to work efficiently for cable or cable-like structure releasing and retracting.

In one or more aspects of the embodiment of the present invention describe two effective means for cable or cable-like structure to be released from or retracted into the device, including the manually releasing and retracting means (MRR means) and the manually and automatically releasing and retracting means (MARR means). In MRR means, the case of MRR means is directly fastened with the flange and therefore the cable or cable-like structure can be retracted into the device by simply turning the case of MRR means. Comparison of MRR means, the MARR means combines manually and automatically releasing and retracting together. The pulling force, when the cable is pulled out from the device, will result the spring to change from the static to the contracted state. When the lock means is opened by using the pushing button, the spring tension will retract the cable or cable-like structure into the device. On the other hand, the MRR means or MARR means are an additional way to help cable or cable-like structure releasing from or retracting into the device, because cable or cable-like structure may be stuck due to any mechanical reason of the device, or may be stuck due to the deformation or twist of cable or cable-like structure.

In one or more aspects of the embodiment of the present invention application describe several structures which enable the device to be used at many convent ways, such as the movable hang ring on the top cover allows the device can be hanged on a nail when the device is using or is storing for further application, the foldable post and the hole on the outer wall of the housing allow the using devices to be link each other, which make the devices not only use for cable or cable-like structure releasing, retracting and storing, also provide a way to decorate private or public environment, especially when the housing of the devices with different colors.

Still, the features and advantages of such implementations may be realized and obtained by means of the instruments and combinations particularly pointed out in the appended claims. These and other features of the cable or cable-like structure releasing, retracting and storing device will become more fully apparent from the following description and appended claims, or may be learned by the practice usage.

BRIEF DESCRIPTION OF THE DRAWINGS

A more particular description of the invention briefly described above will be rendered by reference to specific embodiments thereof which are illustrated in the appended drawings for the purpose to describe the manner in which the above-recited and other advantages and features of the invention can be obtained.

For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which:

FIG. 3A to FIG. 9B are exploded and perspective views in accordance with more implementation of the present invention, including the top cover 200, the lock means 400, the RRRS means 500, the housing 600, the MRR means 700 or the MARR means 800, the bottom cover 900, and the relationships between these individual parts with specific functions.

FIG. 3A to FIG. 3C illustrate an exploded view and a perspective view to detail the structure of the top cover of the device;

FIG. 9A and FIG. 9B are exploded and perspective views of the bottom cover.

DETAILED DESCRIPTION OF THE PREFERRED EMBODIMENTS

Figure 1A:
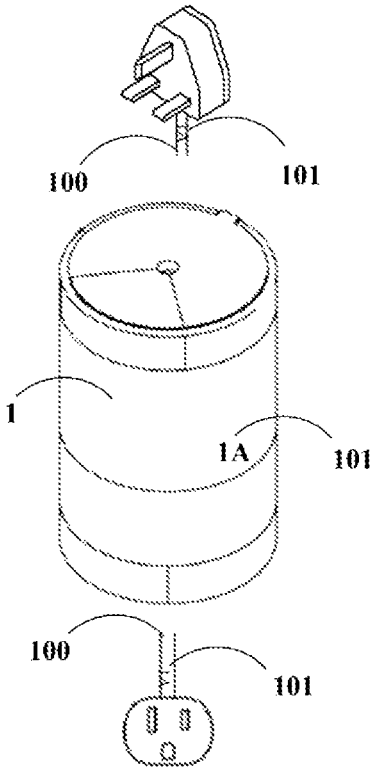
FIG. 1A and FIG. 1B are a perspective view and an exploded view of the device used for release, retract and store a cable or a cable-like structure in accordance with an implementation of the present invention.

Detail descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled on the art to employ the present invention in virtually any appropriately detailed system, structure or manner. Referring to the drawing figures, like reference numerals designate identical or corresponding elements throughout the several figures.

FIG. 1A is a perspective view of the device used to release, retract and store cable or cable-like structure (hereinafter, device) 1. The device and cable are also marked with letter "1A" 101, which will be a simple way to find out the cable 100 and the device 1 from many using cables in the same area.

Figure 1B:
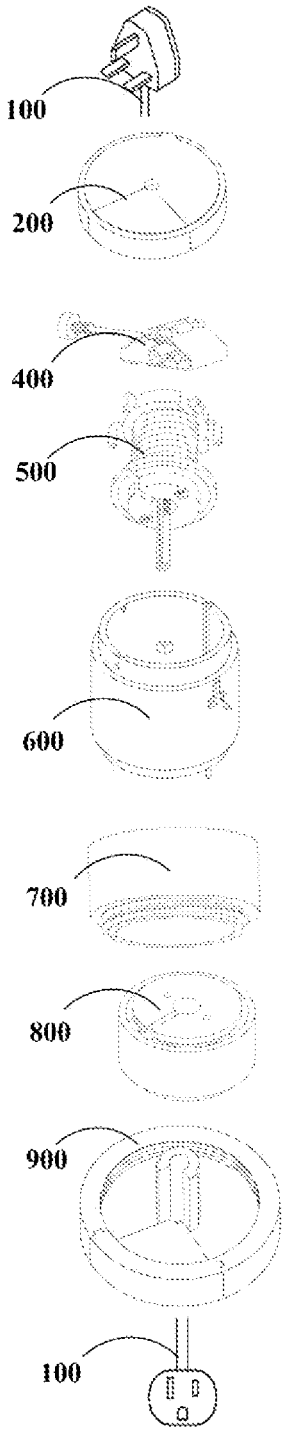

FIG. 1B is an exploded perspective view to show the main constitutions of the device 1 used to release, retract and store cable or cable-like structure. The cable 100 is a collective word with no limitation, since the device can be used for all kind cables, for example, with pre-existing various shaped or functional male and female plugs on both ends or one end with plug or no plug. As a collective word, it shall include all type of cable-like structures, such as rope, string, line, metal wire, wire cable, pipe, tube, hose and all unmentioned similar or alike structures. The top cover 200 and the bottom cover 900 are used to seal the device 1. The lock means 400 is used to lock and limit the cable 100 to release from the device 1 or recover from outside into the device 1. The rotatably releasing, retracting and storing means (hereinafter, RRRS means) 500 is used to regulate the cable 100 or cable-like structure releasing from device 1, retracting the cable or cable-like structure into the device 1 and storing the retracted cable or cable-like structure in the device 1. The lock means 400 and the RRRS means 500 are placed inside the housing 600 all the time. Manually releasing and retracting means (hereinafter, MRR means) 700 is manually help to retract the cable 100 or cable-like structure into the device 1. The MRR 700 can be replaced with the manually and automatically releasing and retracting means 800 (hereinafter, MARR means), which is used to manually and automatically to pull out the cable 100 or cable like structure from the device 1 or to retract the cable 100 into the device 1.

Figure 2A:
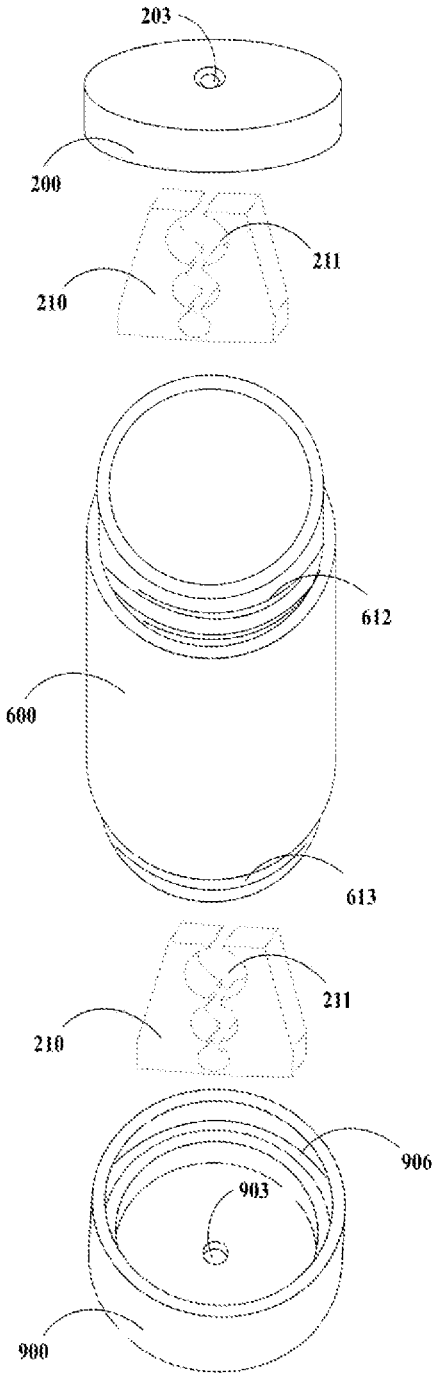
FIG. 2A to FIG. 2F are exploded views and perspective views in accordance with one implementation of the present invention of the device.

FIG. 2A to FIG. 2G are perspective view and exploded view of device 1 and the adjustable winding bracket used to coil a cable or a cable-like structure. The device 1, in one embodiment of the present invention in FIG. 2A, is constituted of the top cover 200, the stoppers 210, the housing 600 and the bottom cover 900. This device allows the cable 100 with one plug or without pugs, or the cable-like structure with one functional structure or without any functional structure to use, since the central hole 203 in the top cover 200 or the central hole 903 in the bottom cover only allow the cable or cable-like structure 100 without plugs or other structure to pass through directly. The pair stoppers 210 are a simple way to hold the cable or the cable-like structure inside the device 1. The stopper 210 allows cable or cable-like structure to be pull out from the device 1. However, the cable 100 or cable like structure has to be manually retracted into the device after opening the top cover or bottom cover.

Figure 2B:
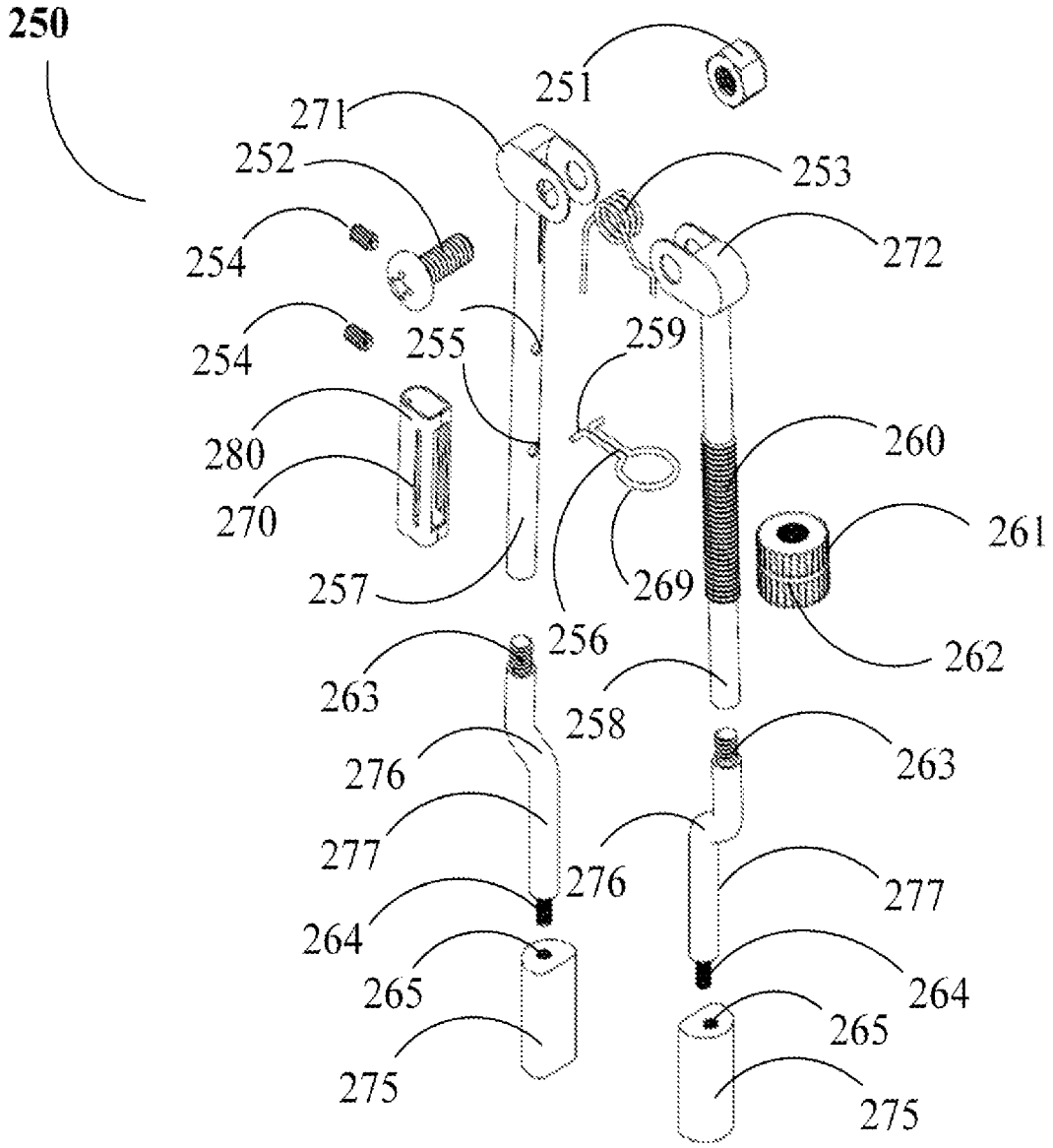
Figure 2C:
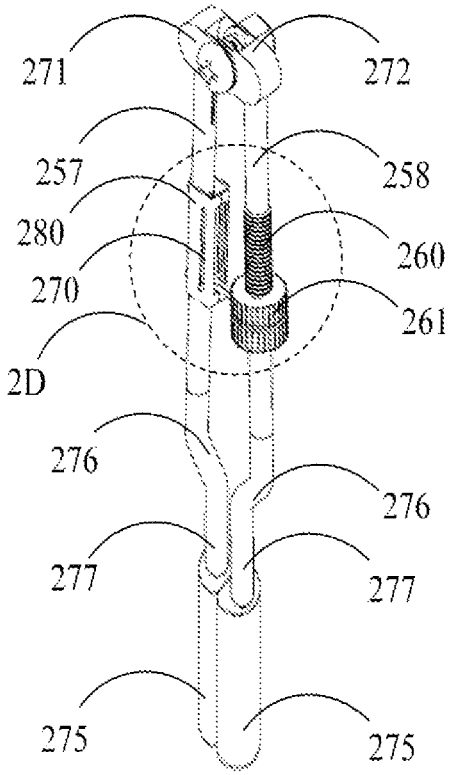

FIG. 2B and FIG. 2C are an exploded view and an assembled perspective views of the adjustable cable coiling tool 250. The adjustable cable coiling tool 250 is an independent and additional tool used to coil the cable or cable-like structure, and to send the well-coiled cable or cable-like structure to the hushing means 600. The adjustable cable coiling tool 250 is consists of the first member 257 and the second member 258. Both the first member 257 and the second member 258 have protrusions, 271 and 272, on the top end. The protrusions, 271 and 272, jointly linked by the spring 253 and fastened with each other by the bolt 252 and the nut 251. As result, the jointed protrusions form a better place to house the spring 253. The sleeve-like locking frame 280 is movable sleeve onto the first member 257 and further is locked by screws 254 via the two threaded holes 255 on the first member 257. Accordingly, the spring 253 provides the opening force for the jointed first member 257 and second member 258 when the movable elasticity bracket 256 controlled by the movable knurled thumb nut 261 and the sleeve-like locking frame 280 via the locking channels 270. The locking channels 270 are on the both side walls of the sleeve-like locking frame 280. The big circular part 269 of the movable controlling spring bracket 256 is sleeve onto the recess 262 on the movable knurled thumb nut 261. The pair perpendicular convexes 259 of the movable controlling spring bracket 256 are inserted into the locking channel 270 to limit the movable controlling spring bracket 256 to be able to move only up and down or left to right along the locking channel 270. The movable movable knurled thumb nut 261 is sleeve onto second member 258 and further to fasten with the threaded part 260. The movable knurled thumb nut 261 is further control the movable controlling spring bracket 256 to adjust the spacing between the upright parts of the third and the fourth members 277, which matches with different inner diameter of the housing 600.

The third and fourth member comprise a bended parts 276 with threaded top end 263 and an upright parts 277 with threaded lower ends 264. The threaded parts 263 will fasten with the lower end of the threaded first member 257 and the threaded second member 258. Regardless of the change of the angle between the first member 257 and the second member 258, the bended portion 276 allows the upright parts 277 to remain in a vertical state. The threaded holes 265 on the pair of coiling parts 275 will fasten with the threaded lower end 264. The pair of coiling parts 275 of the adjustable cable coiling tool 250 are the place used to coil the cable. In the case, when the selected diameter, the pair of coiling parts 275 of the adjustable cable coiling tool 250, as outer diameter, is smaller than the inner diameter of the housing 600, the movable knurled thumb nut 261, the sleeve-like locking frame 280 and the movable controlling spring bracket 256 will lock the first member 257 and second member 258. The coiled cable and the adjustable cable coiling tool 250 can be inserted into the housing 600. By adjusting the movable knurled thumb nut 261 and making the pair of ninety degree convexes 259 of the movable controlling spring bracket 256 to align the mark "R" on the the sleeve-like locking frame 280 (as detail in FIG. 2D), the well coiled cable 100 will releasingly detach from the coiling parts 275 and further allow the adjustable cable coiling tool 250 to move out the housing 600, but leave the cable 100 inside the housing 600. As shown in FIG. 2C, the adjustable cable coiling tool 250 is in the fully closed state.

Figure 2D:
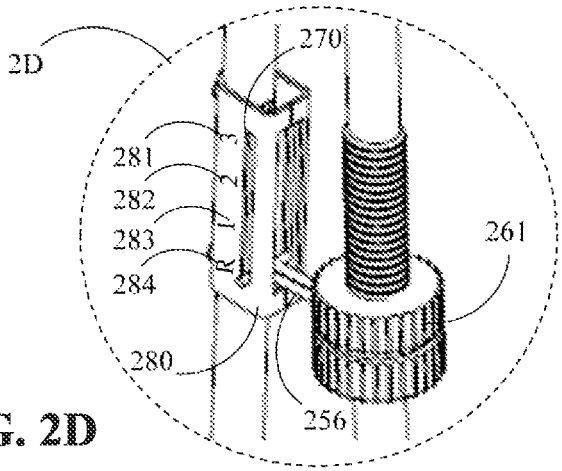

FIG. 2D is a partial enlargement view to detail the guiding scale of the adjustable cable coiling tool 250. The numbers on the sleeve-like locking frame 280 represent different inner diameter of the housing 600. For example, the number 1, indicated by 283, represents the smallest inner diameter of the housing 600; the number 2, indicated by 282, represents the medium inner diameter of the housing 600; and the number 3, indicated by 281, represents the largest inner diameter of the housing 600. The letter "R", indicated by 284, is a releasing mark. After the cable 100 or cable-like structure is well coiled onto the first member and the second member, 257 and 258, the adjustable cable coiling tool 250 with cable 100 are inserted inside the housing 600. By turning the movable knurled thumb nut 261 and making the the pair of ninety degree convexes 259 of the movable controlling spring bracket 256 align to letter "R" 284, the adjustable cable coiling tool 250 is releasingly loosed from the coiled cable. As result, the well coiled cable 100 or cable-like structure will be perfectly and orderly left inside the housing 600.

It is understandable that the upright parts 277 can be produced at any length as required and that the pair of the handles 275 can be replaced with various different structures or means used for special application.

Figure 2E:
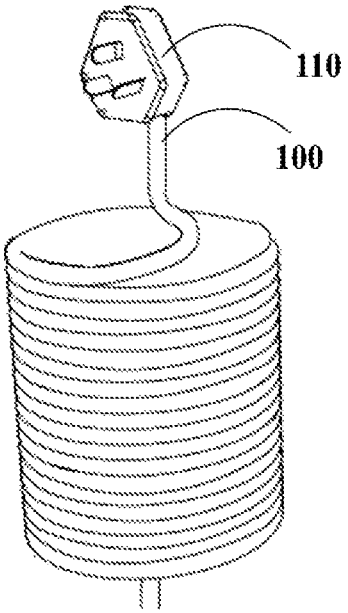

FIG. 2E shows a well coiled cable 100 with one male plug 110 on the top and without plug or any other structure on the lower end of the cable 100. It shall point out that to orderly keep cable inside the housing 600 is very important for safety reason, especially power cable.

Figure 2F:
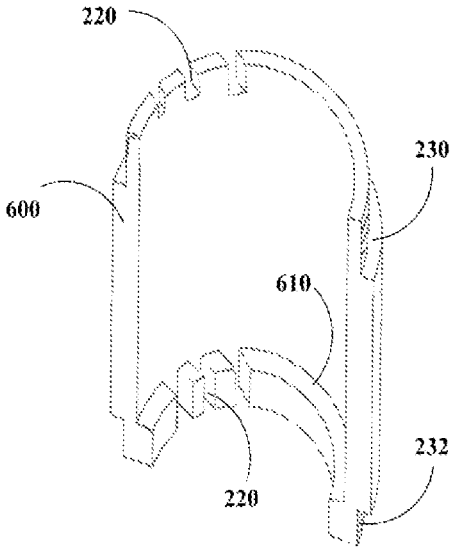

FIG. 2F is a cutaway view to detail the top end, lower end and inside structures of the house 600. In order to prevent well coiled cable 100 from loosing and winding, the top end and lower end of the housing 600 have different sized wire slots 220 so that both end of the cable 100 can be temporarily keep into the matched wire slot 220 before taking off the adjustable cable coiling tool 250. The circular stepped protrusion 610 is used to house the well coiled cable 100 or cable-like structure. The threaded top outer wall 230 and threaded lower outer wall 232 are used to fasten with the top cover 200 and bottom cover 900.

Figure 2G:
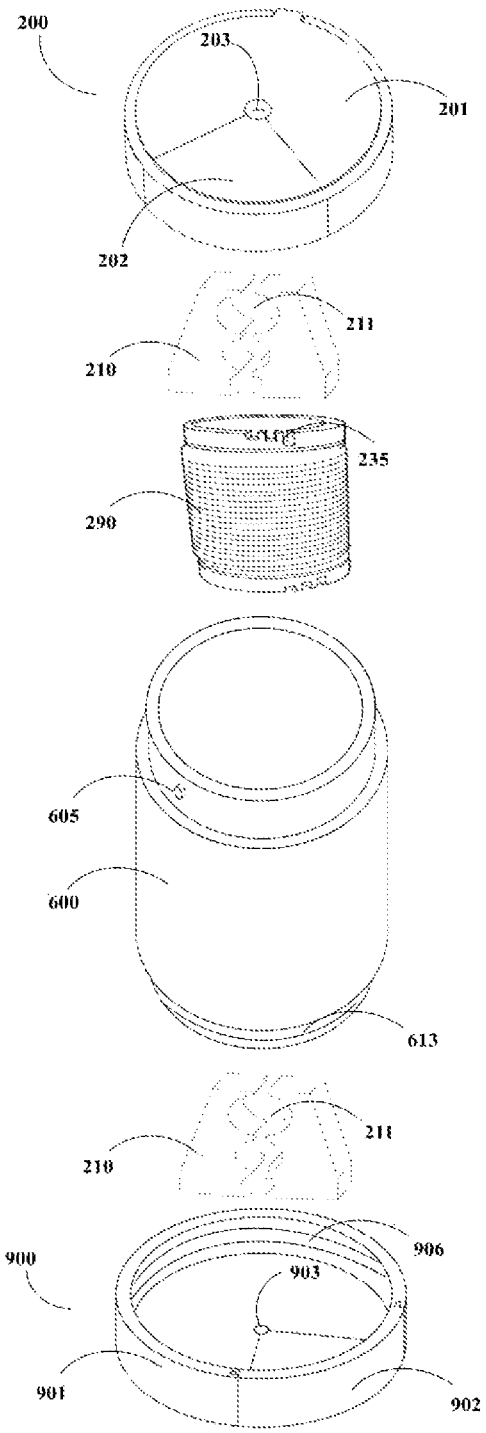
FIG. 2G and FIG. 2I illustrate an exploded view and perspective views in accordance with another implementation of the present invention.
Figure 2H:
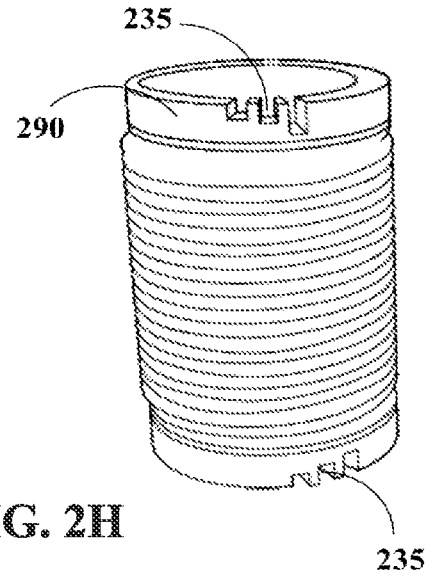

FIG. 2G is an exploded view to detail another embodiment of present invention of the device used to release, retract and store cable 100 or cable-like structure. For those cable 100 with pre-existing plugs or cable-like structure with functional structures on the both ends, the top cover 200 and bottom cover 900 are constituted of main part 201 and movable part 202. The cable 100 with plugs can enter the central hole 203 directly when the movable part 202 is moved away from the top or bottom cover. The detailed structure of both main part and movable part are showed in FIG. 3C and FIG. 9A. For the purpose to orderly keep cable 100 inside the housing 600, the movable cable coiling frame 290, as showed in FIG. 2H, is used to coil cable 100 on the outer wall. The various sized wire slots 235 are used to temporarily keep the top end and lower end of well coiled cable 100 with the movable cable coiling frame 290. The cable 100 will be detached from the top and bottom wire slots will be free once the stopper 210 is employed. The cable 100 is held by one of the proper wire slots 211 of the stopper 210 inside the top cover 200 and bottom cover 900. The wire slot 211 of stopper 210 can grip the cable 100 inside the cover 200 and lower cover 900 so that all the coiled cable can be kept inside the housing 600. The wire slot 211 allows cable 100 to be pulled out to adjust the required length.

Figure 2I:
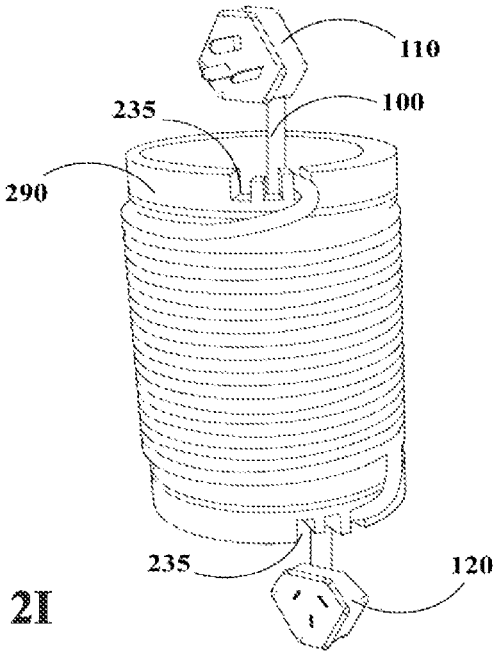

As showed in FIG. 2I, the cable 100 is well coiled on the movable cable coiling frame 290. The cable 100, with a male plug 110 on the top, is inserted into the wire slot 235 on the top end of the movable cable coiling frame 290. The same cable 100, with a female plug on the lower end, is inserted into a wire slot 235 on the lower end of the movable cable coiling frame 290. The movable cable coiling frame 290 with the well coiled cable 100 is then placed on the circular steeped protrusion 610 (as detailed in FIG. 2F and FIG. 6B) of the housing 600.

FIG. 3A to 9B are more embodiments of present invention by various exploded and perspective views to detail each of constituted parts in the device 1, including the top cover 200, the lock means 400, the RRRS means 500, the housing 600, the MRR means 700 or the MARR means 800, the bottom cover 900, and the relationship between these individual parts with specific functions.

Figure 3A:
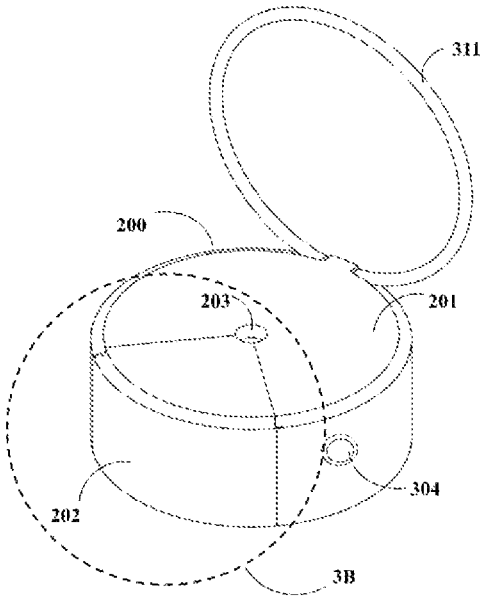
Figure 3B:
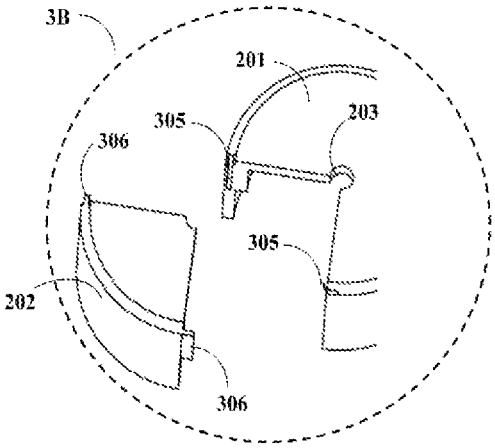

FIG. 3A is a perspective view of the top cover 200 of present device 1. The hole 204 on the side upright wall is used to house the pushing buttons 328 of the lock means 400. The movable hang ring 311 provide a simple way to use or store the device 1 by hanging the device 1 via the hang ring on a nail on the wall or a hook on any place. The central hole 203 is allows cable 100 to movably pass through. The main part 201 and movable part 202 constitute the top cover 200. The detail structure of main part and movable part, as indicated in broken circle line 3B, is showed in FIG. 3B. The main part 201 has two shallow recesses 305 on both side edges which will used to house two convex structures on both edges 306 on the both side edges of the movable part 202. The pair convex structures 306 are inlaid into the pair recesses 305 respectively such that the main part and movable part form an integrated top cover via the jointed convex structures and recesses.

Figure 3C:
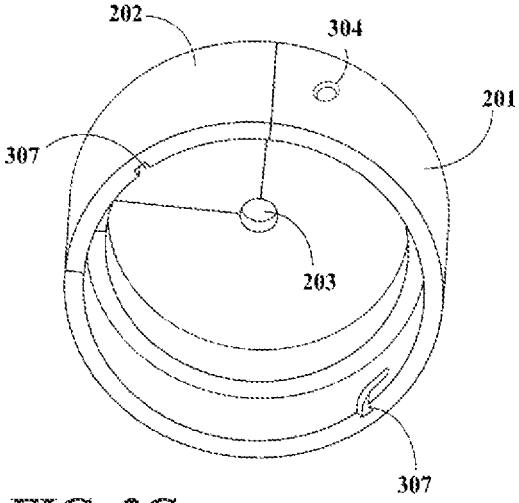
Figure 6A:
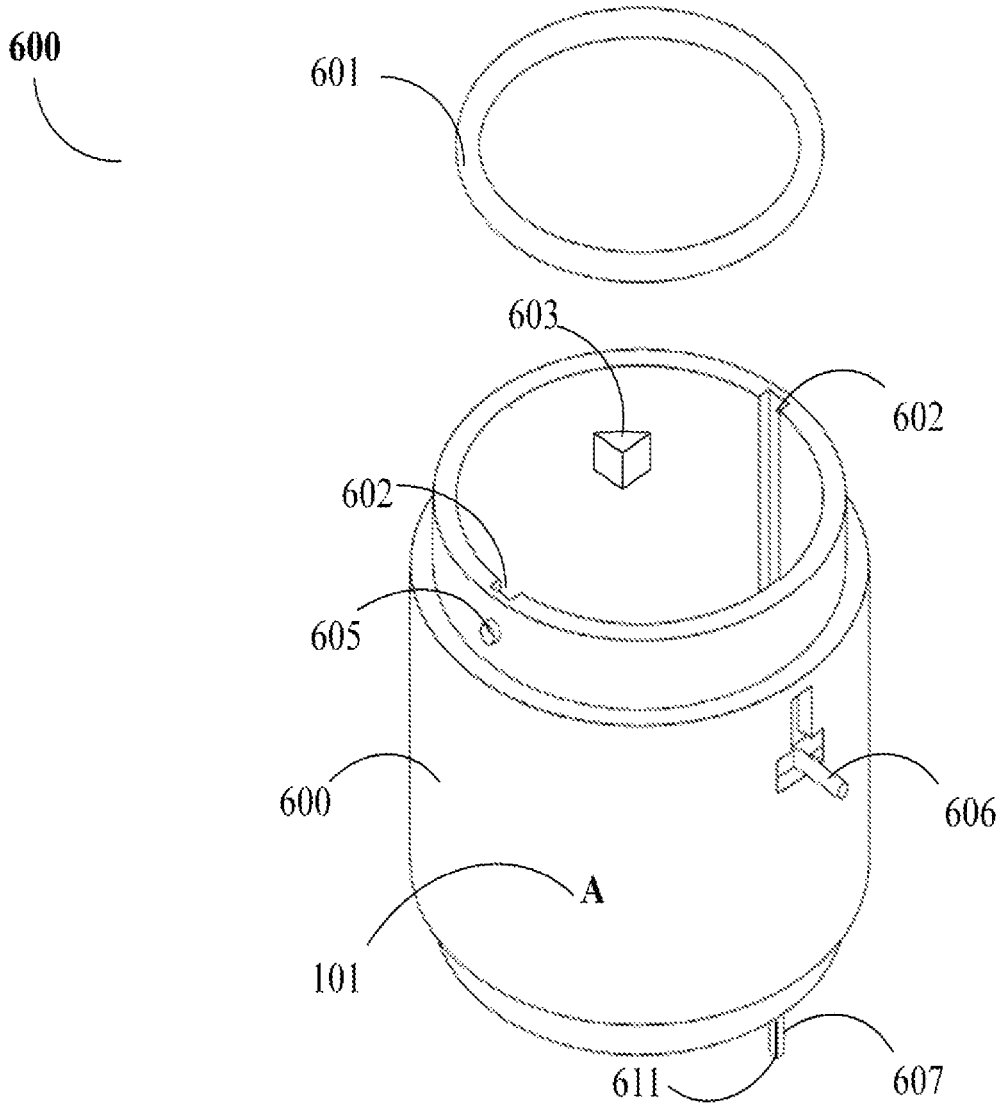
FIG. 6A and FIG. 6B are perspective and cutaway views to detail the housing structure of the device.

FIG. 3C is a perspective bottom-up view of the top cover 200. The two inverted "L" shaped grooves, 307, are used to match with a pair of shorter columnar bulges 605 on the top outer wall of the housing 600 in FIG. 6A, which results the device 1 can be sealed by the top cover 200. One of the inverted "L" shaped grooves 307 is on the main part 201 and the other one is on the movable part 202. The groove 307 on the movable part 202 has a lock function when the shorter columnar bulges 605 in FIG. 6A are connected with groove 307.

Figure 4A:
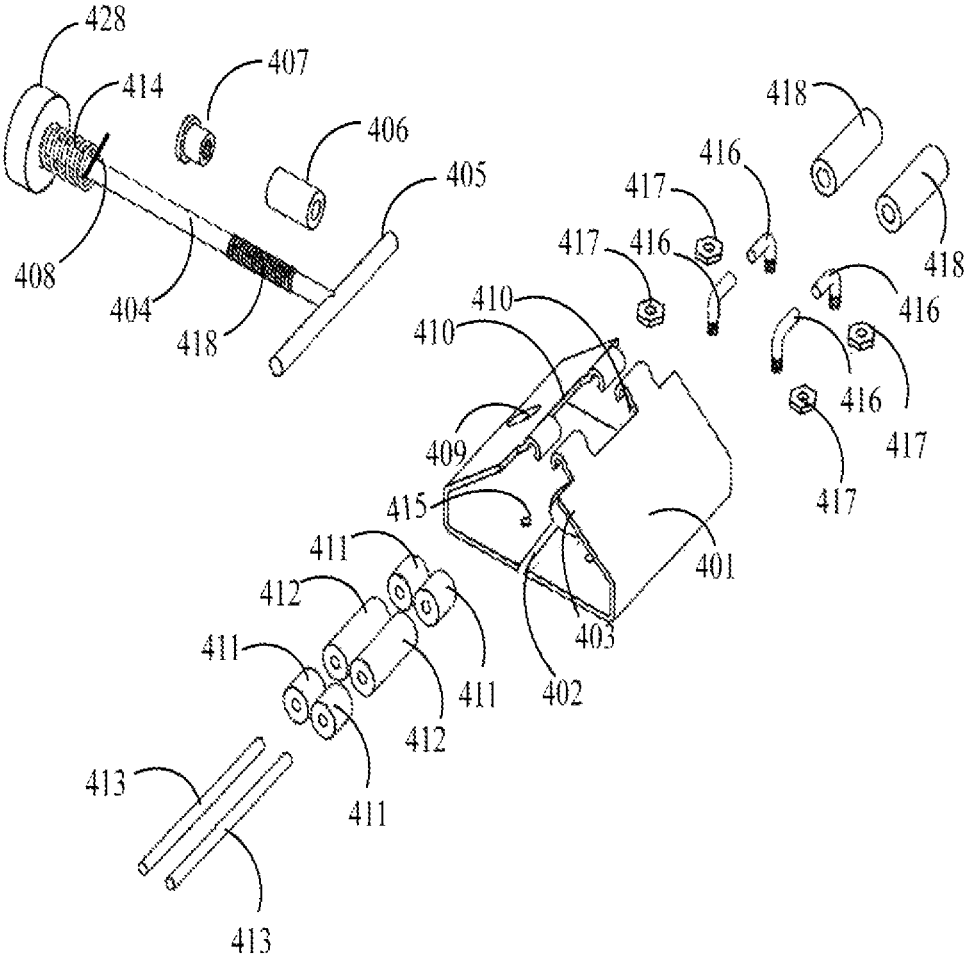
FIG. 4A to FIG. 4C are an exploded view, a perspective view and a partial enlarged view to detail the lock means structure of the device.

FIG. 4A details the structures of the lock means 400 via exploded view. The first metal spring 401 is used to lock and limit the cable 100 to be pulled from or to retract into the device 1. There is a penetrative channel 402 on the bottom of the first metal spring 401 to allow the cable 100 or cable-like structure to pass through and to enter the central hole 403. The first rigid horizontal bars 404, after passing through the hole 409 on the one side of the middle portion of the spring 401, is vertically connected with the second horizontal bar 405. The first rigid horizontal bar 404 is linked with the pushing button 428 used to control the first spring 401 to open when the push button 428 being squeezed. The second spring 414 is used to keep the push button 428 with the top cover 200 tidily all time. The short bar 408 is used to limit the second spring 414 so that the horizontal bars 404 to keep tidily with cover 200 by when the push button 428 is in the rest condition. The central hole 403 on the bottom of the first spring 401 is surrounded by four penetrative holes 415. Each pair of threaded ninety-degree frames 416 pass through the holes 405 and are fastened with the nut 417 to form a full frame to support the sleeve 418.

Figure 4B:
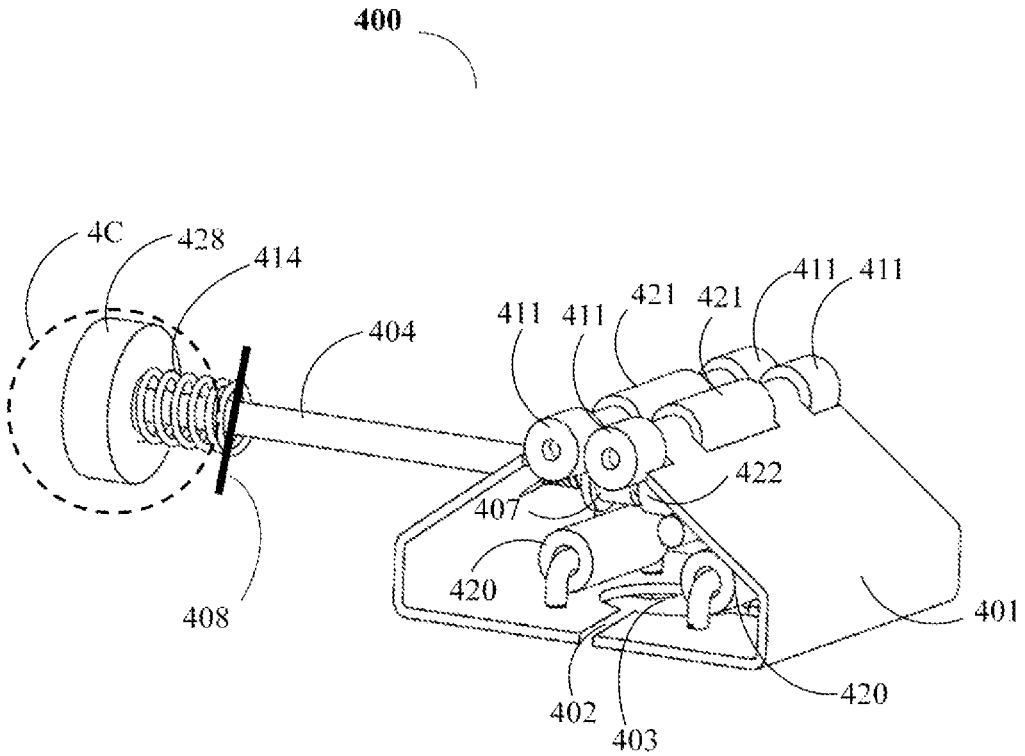

As result, one pair of frames 416 and a sleeve 418 form the directing bar 420, as showed in FIG. 4B, to help the cable 100 or cable-like structure easily moving inside the device 1. There are two cut away parts 410 on the top part of the spring 401, which are used to house a pair of directing bars 421 as showed in FIG. 4B to control the cable 100 or cable-like structure to be input or output as desired. In order to allow the device 1 can be used for various diameter cables 100 or cable-like structures, there is adjusting nut 407 to fasten with the threaded part 418 on the rigid horizontal bars 404. The end 429 of the rigid horizontal bar 404 has a cross screw end used to adjust the space between the top part of the first spring 401 by a screw driver. As result, the first spring 401 can be used for different diameters cable 100 or cable-like structure. The nuts 411, bars 413 and sleeve 412 constitute the directing bars 421 to allow cable 100 moving freely when the cable 100 or cable-like structure being pulling out or retracting into device. The front part of the horizontal bars 404 support the sleeve 406 to form another directing bar 422 as showed in FIG. 4B to help cable 100 or cable-like structure moving in or out freely.

FIG. 4B is a perspective view of the assembled lock means 400. The button 428 is in the rest condition supported by the second spring 414 and the stopper 408. All directing bars, including 420, 421 and 422, help the cable 100 or the cable-like structure to be moved smoothly without being stucked inside the lock means 400 of the device 1. It shall be pointed out that the directing bars 421 as showed in FIG. 4B allow the cable 100 or the cable-like structure to be pull out directly without using the push button. The penetrative channel 402 on the first spring 401 provides a pathway for cable 100 or cable-like structure to enter into the central hole 403. Overall, the function of the lock means 400 is used to control and adjust the length of the cable or cable-like structure to release from or retract to device 1 and keep the cable or cable-like structure in a stationary working state or store state.

Figure 4C:
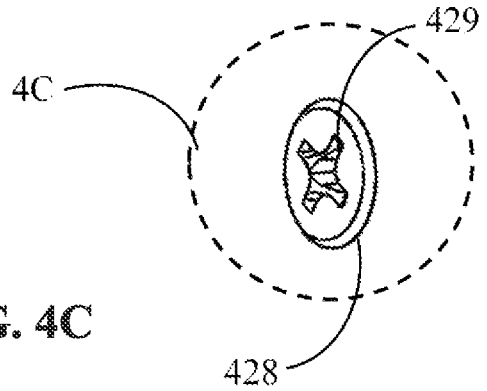

FIG. 4C is a partial enlarged view to detail the out-end structure of the first rigid horizontal bars 404. The cross-screw end 429 linked with the push button 428 is used to adjust the space between the directing bars 421 by screw driver, so that the different diameter cable 100 or cable-like structure is allowable to use the device 1 without needing to replace any part of the device.

Figure 5A:
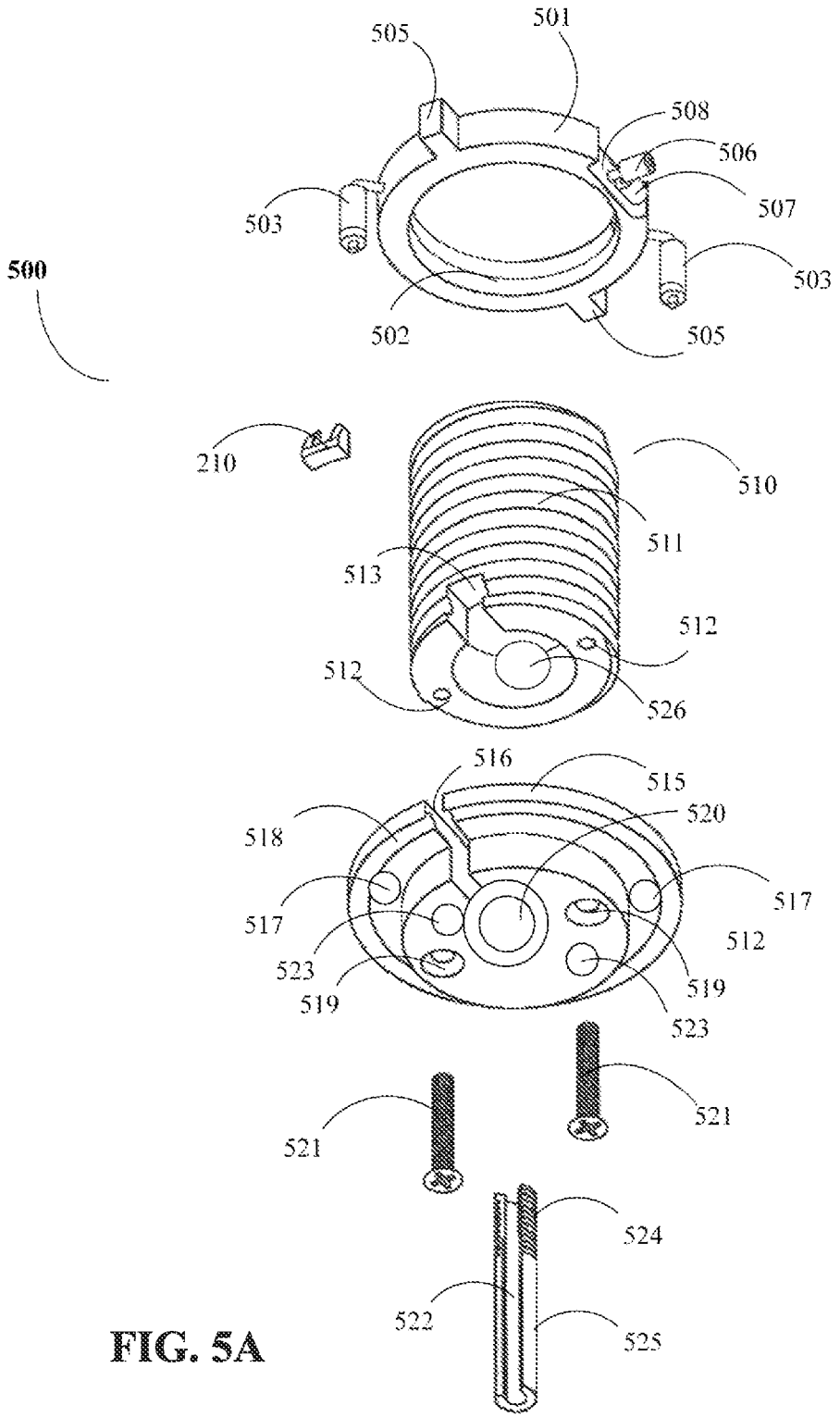
FIG. 5A and FIG. 5B detail the structure of the rotatably releasing, retracting and storing means (hereinafter, RRRS means) of the device by an exploded view and a perspective view.
Figure 5B:
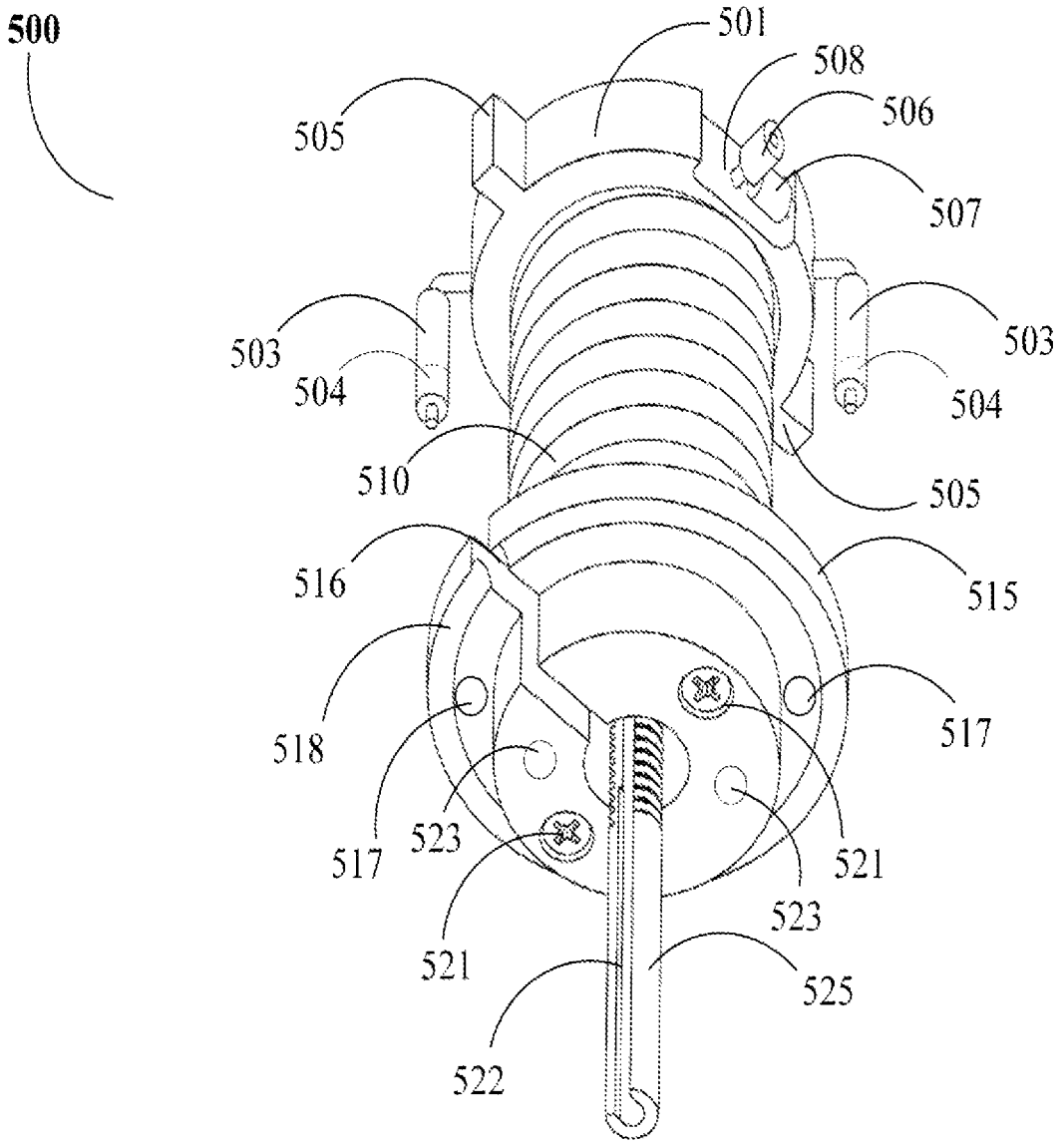

FIG. 5A is an exploded view of the rotatably releasing, retracting and storing means (hereinafter, RRRS means) 500 and FIG. 5B is an assembled perspective view of the RRRS means 500. The vertically movable threaded Regulator (hereinafter, Regulator) 501 is used to regulate the cable or cable-like structure restricting and releasing from or into the device 1 orderly and tidily without any cable or cable-like structure overlapping confusion occurring. The threaded inner wall 502 the Regulator 501 is used to screw with the rod 510 via the helix groove 511. Two directing bars, 506 and 507, located inside the trough 508 by vertical and horizontal way to avoid the cable 100 or cable-like structure touching Regulator 501. The third pair is directing bars 503 on Regulator 501 used to regulate and force the cable 100 or cable-like structure to enter helix groove 511 on the rod 510 without any cable or cable-like structure overlapping confusion. Two convexes 505 keep the Regulator 501 vertically moving when releasing or retracting the cable 100, or cable-like structure—this two convenes 505 held in the vertical grooves 602 on the inner wall housing 600. By pulling the cable or cable-like structure out from device 1, the force from the cable or cable-like structure pulling will cause rod 510 to turn. Such turning results in Regulator 501 vertically moving down along the rod 510. In contrast, when hand turns the MRR 700, the turning force will result in Regulator 501 vertically moving up along the rod 510 and make the cable or cable-like structure return into device 1.

The rod 510 has a helix shallow groove 511 on the outer wall which is used to hold the cable 100 or cable-like structure and also to screw with Regulator 501 via the threaded inner wall. The vertical extent and width of the helix shallow groove 511 is no less than the half of the cable diameter. The notch 513 on the bottom end of the rod 510 is used to fix or fasten the cable 100 or cable-like structure with the rod 510. The cable 100 or cable-like structure must be fixed firmly to rod 510 without any moving from the notch 512 during the device being used to retract or release cable. Therefore, a stopper 514 is further employed for the purpose to firmly fasten the cable 100 or cable-like structure with the rod 510. Two threaded holes 513 on the bottom end of rod 510 are used-to fasten with flange 515 by screws 521. To fasten rod 510 with flange 515 results in rod 510 and flange 515 constituting a complete functional structure.

The circle groove 518 near the edge of bottom of the floating pivot flange 515 is used to mate with the groove 518 on the bottom end of the housing 600 to house the bearing ring 501. As result, a flange bearing is formed for cable 500 or cable-like structure releasing or retracting. When the cable 100 is pulling out, the jointed floating pivot flange 515 and the rod 510 will rotate and result the Regulator 501 to move down along the groove 602 of the housing 600. The floating pivot flange bearing allow the device 1 to perform light duty application. The central threaded penetrative hole 520 on flange 515 and the penetrative channel 516 linked to allow the cable 100 or cable-like structure to pass through and finally reach to the central hole 520. Two threaded step holes 519 are used to fasten the 5 flange 515 with the rod 510 via the pair threaded 512 by bolts 516. The threaded holes 523 are used to link the protecting flange 801 in the MARR means 800 as detailed in FIG. 5A. The threaded holes 517 on the flange 515 are used to fasten with the threaded holes, 703 and 704, on the MRR means 700 with the screws 707 (see FIGS. 5A and 5B for details). The fastening of flange 515 with the MRR means results in the RRRS means, and MRR means constituting an integrated structure for performing cable or cable-like structure releasing from or retracting into the Device 1. The most crucial function of such connecting is that MRR ensures the floating flange bearing structure is adequately connected and the formed floating flange bearing structure that won't separate during the RRRS means working. In any case, releasing or retracting cable or a cable-like structure from device 1, RRRS 500 will turn freely by following the pulling force or retracting force steadily without causing RRRS 500 to get out from the housing 600 or any potential damage. In conclusion, RRRS 500 is the core part of device 1 and consists of Regulator 501, Rod 510, Flange 515, and Tubular structure 525. The core function of RRRS 500 is to release, retract, and store a cable or a cable-like structure. Through cooperating with and assisting from housing 600, top cover 200, the lock means 400, MRR means, or MARR means, and bottom cover 900, RRRS 500 can perform the most crucial function in releasing, retracting, and storing cable or cable-like structure.

The tubular structure 525 is used to hold the cable 100 or cable-like structure. The threaded top end 524 of the tubular structure 525 is used to fasten with central threaded penetrative hole 520 of the 5 flange 515. The cut away part 522 is a pathway to allow the cable 100 or cable-like structure to be squeezed into the tubular structure 525. The tubular structure 525 is a holder to insert the inner end 806 of spring 808 in the MARR means 800. The tubular structure 525 inserts into the inner end 806 of spring 808. When releasing a cable or a cable-like structure from device 1, the inner end spring 806 will rotate in the same way as RRRS 500, which drives contractions of spring 808 because the out end spring 807 is locked by the bolt 607.

FIG. 6A demonstrate the perspective view of the housing 600. The movable ring 601 is housed in the circular recess 608 on the circular stepped protrusion 610 on the lower portion of the housing 600. The pair grooves 602 on the inner wall of the housing 600 are used to house the pair convex structures 505 of the Regulator 501. This pair grooves 602 further limit the Regulator 501 can only move vertically up or down, when the RRRS 500 rotates for releasing or retracting the cable or cable-like structure. There are four convex structure 603 on the top portion inner wall of the housing 600, which are used to support the lock means 400. Two shorter columnar bulges 605 on the top portion of outer wall of the housing use to mate with inversed "L" shaped grooves 307 on the inner side of the top cover 200 so that the top cover 200 will fasten with the housing 600. The foldable post 606 on the outside wall of the housing 600 provides a way to enable each individual device to be linked each other. All devices can be linked together and hang up on the wall tidily. The bolt 607 has a gap 611 used to jointly bind the out end 807 of the spring 808 in the MARR means 800.

Figure 6B:
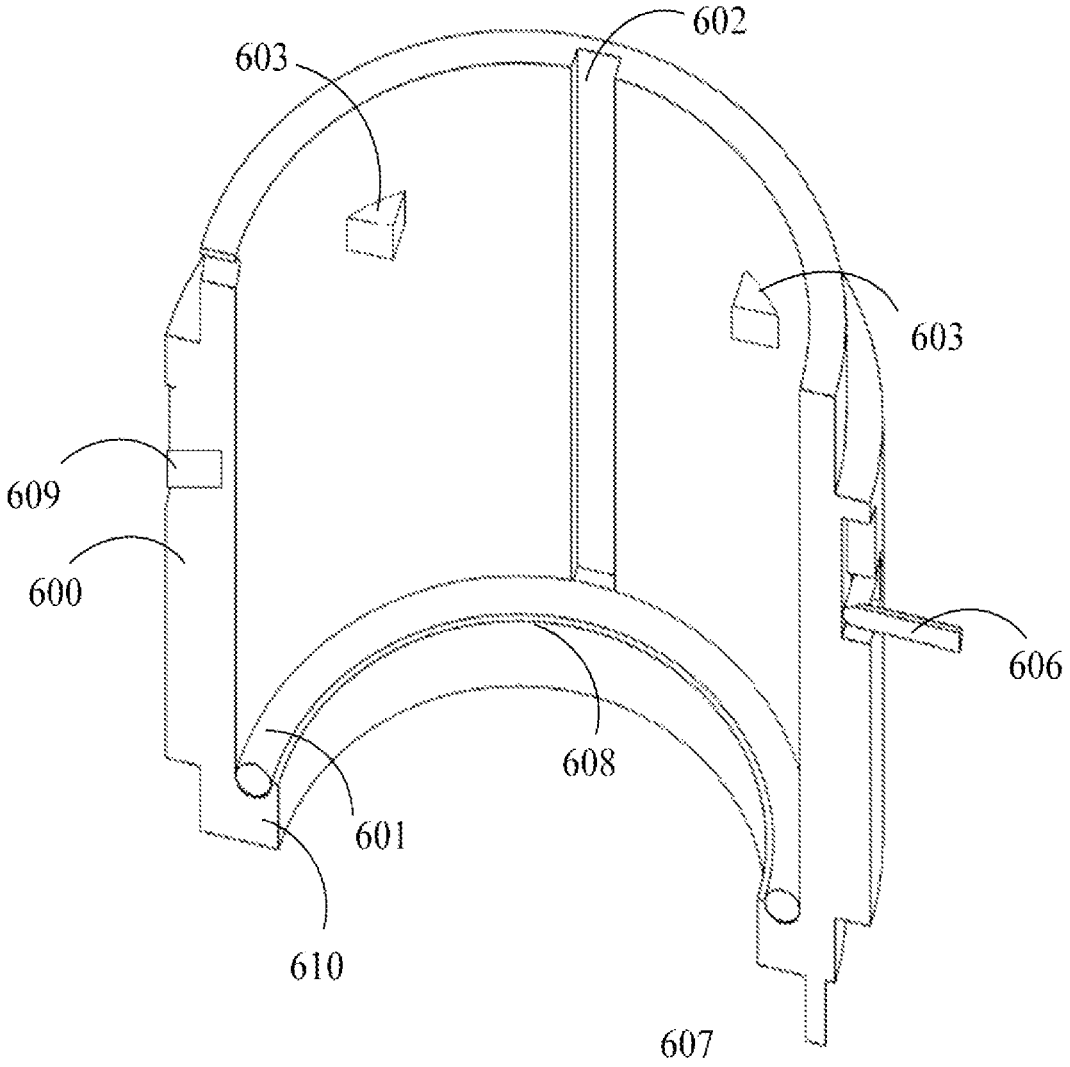

FIG. 6B is a cut away view of the housing 600 to detail inner structures. The convexes 603 are used to support the first spring of the lock means 400. The groove 602 is used to house one of the pair convexes 505 of the Regulator 501 (as showed in FIG. 5). The circle recess 608 on the circular stepped protrusion 610 is used to house the movable ring 601. The circle recess 608, the sandwiched movable ring 601 and the recess 518 on the bottom side of the flange 515 (as showed in FIG. 5) constitute a floating flange bearing. The foldable post 606 is a way to allowed each of devices to link each other by inserting the post 606 into the groove 609 of another device 1. The bolt 607 is used to lock with the outside end 807 of the spring 808 in MARR 800. Overall, housing 600 allows lock means 400, RRRS means 500, and cable 100 or cable-like structure to reside and functionally plays crucial roles for the whole device to work correctly. The circle recess 608, the ring 601, and the recess 518 on the bottom flange 515 have formed a floating flange bearing structure, which plays an irreplaceable function to allow the RRRS means 500 to be routable releasing and retracting cable or cable-like structure. The grooves 602 provides a unique way to keep all functional parts of RRRS, rod 510, flange 515, and tubular structure 525 in a stable dynamic working state for cable or cable-like structure releasing or retracting.

Figure 7A:
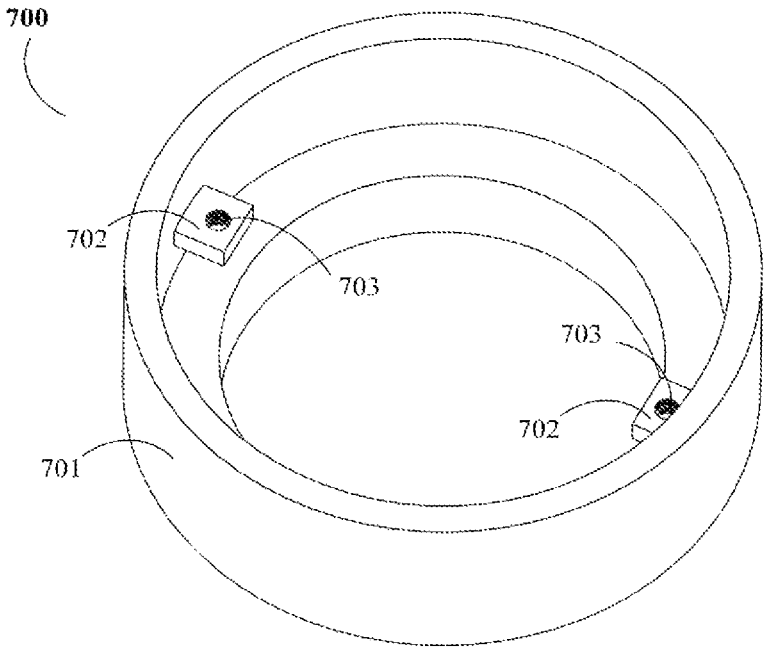
FIG. 7A and FIG. 7B are perspective views of the manually releasing and retracting cable or cable-like structure means (hereinafter, MRR means)
Figure 7B:
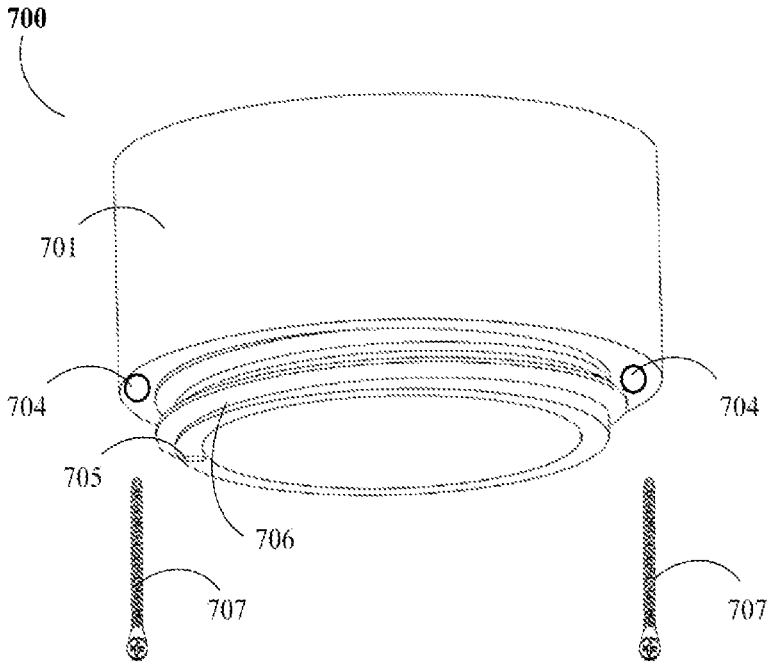

FIGS. 7A and 7B show the structure of the MRR means 700 via the front perspective view and top perspective views. The case 701 of the MRR means 700 is a manually tuning tool used to retract the cable 100 or cable-like structure from outside of the device 1 to inside of the device 1 via the rotatably releasing, retracting and storing means 500. Two convexes 702, with threaded holes 703 on the inner wall of the case 701 are used to support the flange 810. The MRR means 700 will jointly fastened with the RRRS means 500 via the screws 707 through the threaded holes 703 and 704 and the threaded holes 517 on the flange 515 (see FIGS. 5A and 5B for details). These connections show that the RRRS means 500 and MRR means 700 are integrated structures. The force from pulling cable 100 or cable-like structure will result in not only the RRRS means 500 turning, but also the MRR means 700 rotating in the same manner same direction. In contrast, when hand-turning MRR means 700 to retract the cable or cable-like structure, the RRRS means 500 turnings will turn in the same way as MRR means 700 does. Unique and outstanding features of MRR means 700 are to lock the floating flange bearing structure and ensure that the formed floating flange bearing design rotates correctly without separating. Unique and outstanding features of MRR means 700 are to lock the floating flange bearing structure and ensure that the formed floating flange bearing design rotates correctly without separating. Unique and outstanding features of MRR means 700 are to lock, but not a deadlock, the floating flange bearing structure between RRRS means and housing and ensure that the formed floating flange bearing structure rotates correctly without separating from ring 601. Manually hand turning to retract the released cable, or cable-like structure is another unique function of MRR means 700 that differs from all other described structural parts.

Figure 8A:
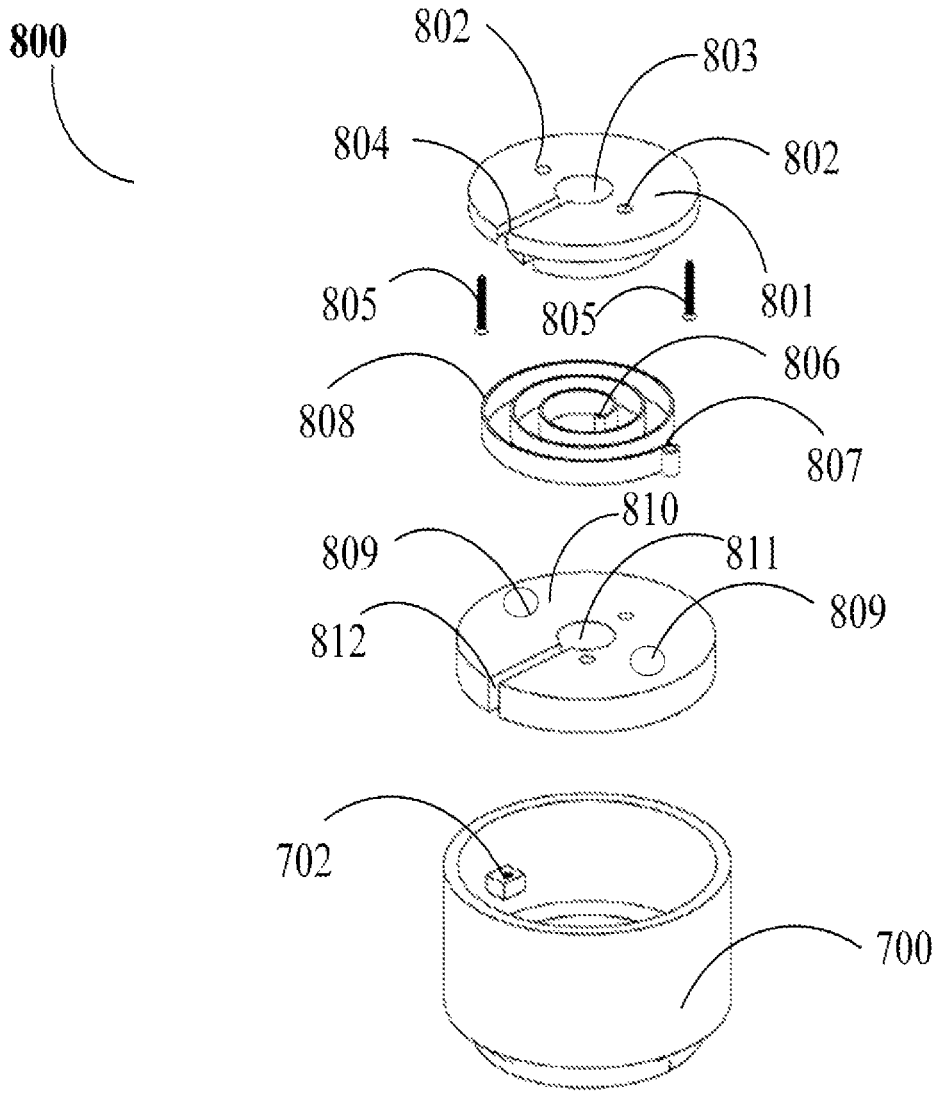
FIG. 8A and FIG. 8B are exploded and perspective views of the manually and automatically releasing and retracting means (hereinafter, MARR means)

FIG. 8A is an exploded view of the MARR means 800 used to retract the cable or cable-like structure. The flange 801 is used to protect the spring 808 and is therefore to fasten with the threaded holes 523 on the flange 515 by the screws 805 via the threaded holes 802. The channel 804 is allowed the cable 100 or cable-like structure to pass and further to enter the central hole 803. The central hole 803 is also allowed the tubular structure 525 to pass through.

Spring 808 has an inner end 806 and outer end 807. The outer end 807 of the spring 808 is locked with bolt 607 on the bottom end of the housing 600 to form an immovable fulcrum. The inner end 806 is locked with the convex 905 of the tubular structure 904 on the bottom cover 900 to form a movable fulcrum. The inner end 806 passes through the tubular-like structure 525, and the tubular-like structure 525 and the inner end 806 of spring are placed into the tubular structure 904 on the bottom Cover 900. Thus, the inner end 806 is trapped and locked between the tubular-like structure 525 and the tubular-like structure 904 of the bottom Cover 900. The locked inner end 806 synchronously moves with the flange 515 in the RRRS means 500, since flange 810 is fastened with the flange 515 by the screws 707.

Flange 810 is used to house Spring 808. Threaded holes, 809, on flange 810, jointly with threaded holes, 703 and 704 in the MRR 700, are fastened with threaded holes 517 in the flange 515 (refer FIGS. 5A and 5B) by screws 707. These fastening results made the RRRS 500 and MARR 800 one functional structure for cable or cable-like structure releasing and retracting. Notably, the fastenings, via threaded holes, 809, 703, 704 and 517 and screws 707, ensure that the formed floating flange bearing structure, recess 518, movable ring 601 and recess 608, won't separate during releasing or retracting a cable or a cable-like structure. The channel 812 allows the cable 100 or cable-like structure to pass and further to enter the central hole 811. The central hole 811 also allows the tubular structure 904 of the bottom cover 900 to pass through.

Figure 8B:
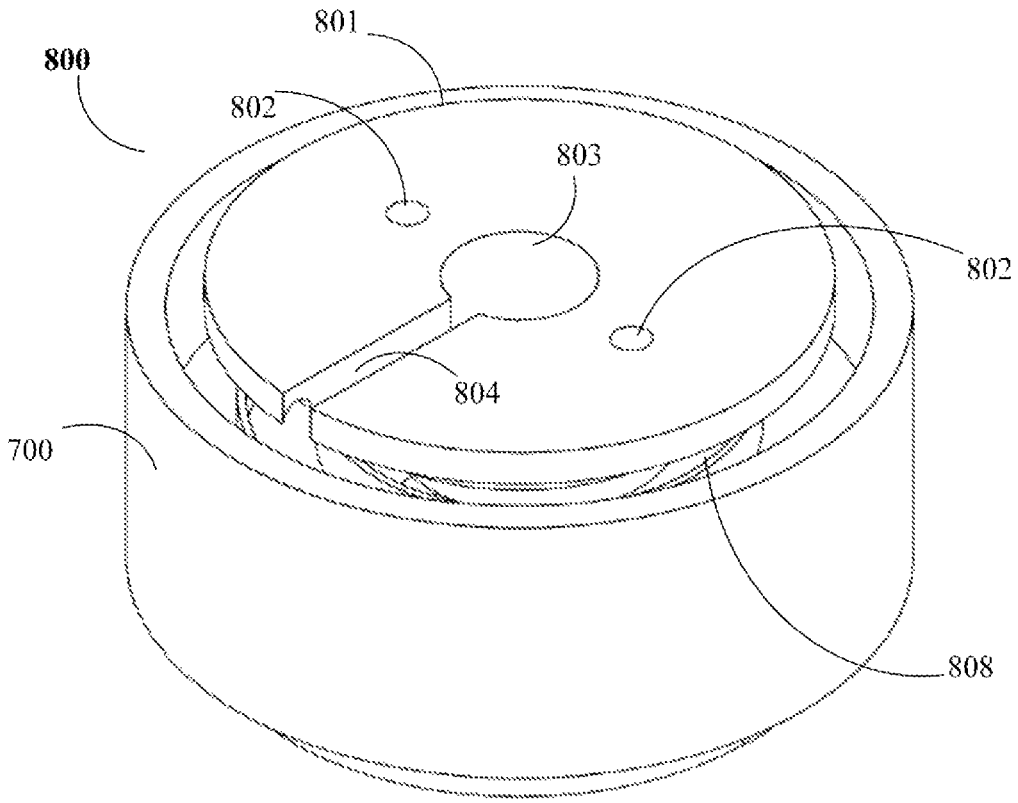

FIG. 8B is an assembled perspective view of the MARR means 800. The flange 801 has two threaded holes 802 fasten with the holes 523 on flange 515 by screws 805. The central hole 803 is used for the tubular structure 525 to pass through. The channel 804 is a way for preexisting plugs cable 100 to enter the central hole and further to get into the tubular structure 525. Flange 801 is used to protect spring 808 in MRR 700.

Figure 9A:
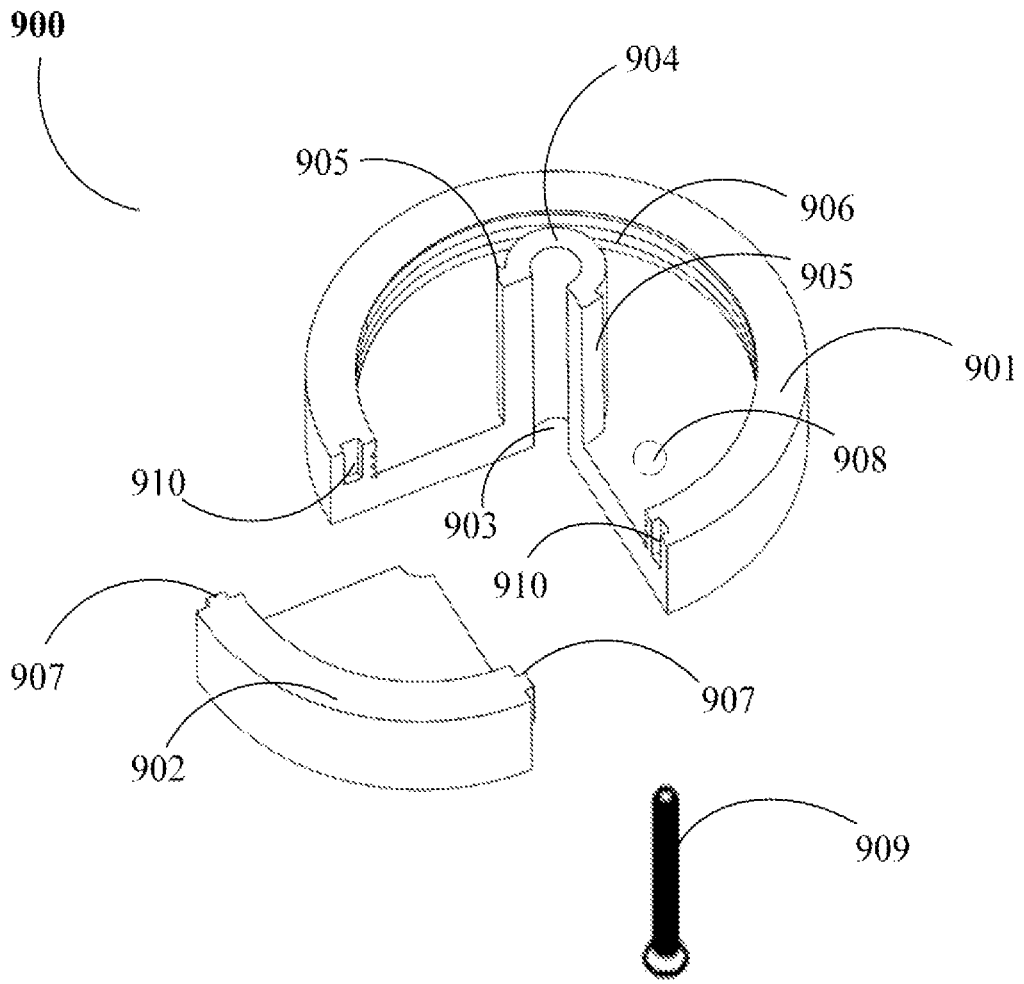
Figure 9B:
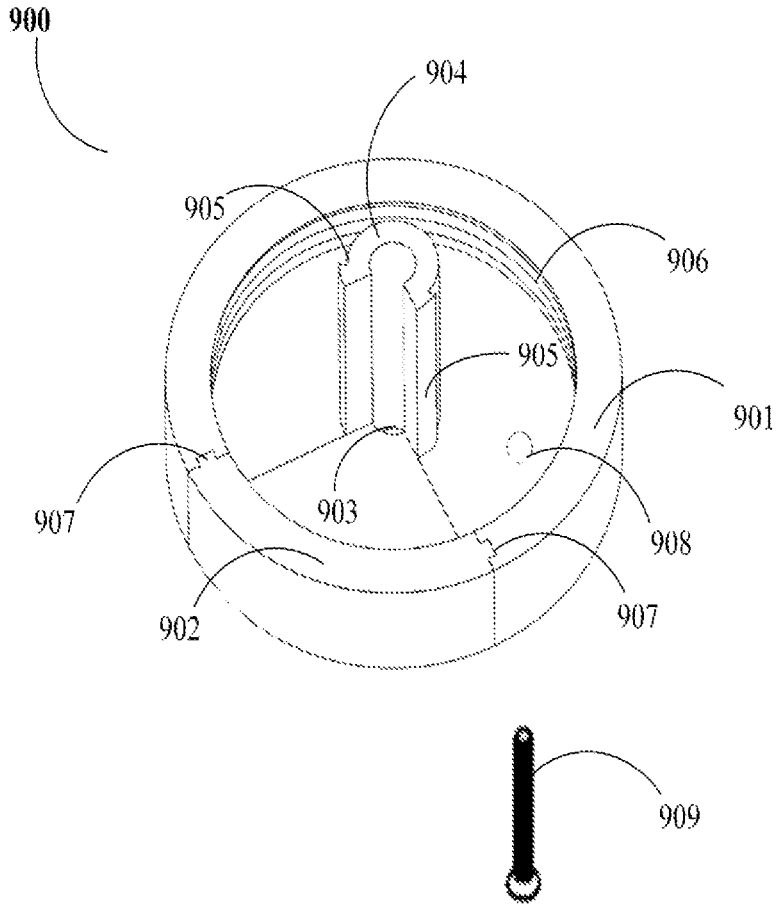

FIG. 9A is an exploded view of the bottom cover 900 and FIG. 9B is a assembled perspective view of the bottom cover 900 used for cable 100 or cable-like structure with preexisting plugs or other structures. The bottom cover 900 has a main part 901 and a movable part 902. The threaded inner wall 906 is used to screw with the threaded bottom part 706 of the structure of MRR 700. The tubular structure 904 uses to house and lock the inner end 806 of the spring 808, the tubular structure 525 and cable or cable-like structure. Two ninety-degree convexes 905 protect the inner end 806 from blocking due to the force directions change of pulling or turning. Hole 903 allows the cable 100 or cable-like structure to enter the hollow tubular structure 904 and further to get into the tubular structure 525. There are two recesses 910 on both edges of side upright wall 901 which is used to house the two convexes 907 on the both edges of side upright wall of the movable part 902. The threaded inner wall of the bottom cover 900 is fastened with the threaded bottom end 706 of the case 701. The hole 908 is a second way to secure the bottom cover 900 to be firmly fastened with the threaded hole 705 of MRR 700 via the screw 909.

It will be appreciated by those skilled on the art that the present invention can be embodied in other specific forms without departing from the spirit or essential characteristics thereof. The presently disclosed embodiments are therefore considered in all respects to be illustrative and not restricted. The scope of the invention described by the foregoing includes all changes that come within the meaning, range, and equivalence thereof and is intended to be embraced therein.

What is claimed are:

1. A device used to release, retract, and store a cable or a cable-like structure comprising:
- a top cover;
- a bottom cover;
- a sandwiched housing;
- a pair of stoppers;
- a cable or a cable-like structure; and
- an additional adjustable cable coiling tool;
- wherein the top cover and the bottom cover having:
  - a threaded inner wall; and
  - a central penetrative hole;
    - wherein the top cover and the bottom cover allow the cable or the cable with one pre-existing plug or one pre-existing plug-like structure to pass through the central hole;
    - wherein the top cover and the bottom cover allow the cable-like structure or the cable-like structure with one pre-existing connector or one pre-existing connector-like structure to pass through the central hole;
- wherein the sandwiched housing having:
  - a circular stepped protrusion on the inner wall of the lower portion,
    - wherein the circular stepped protrusion has different sized wire slots; and
  - a plurality of different sized wire slots on the top end of the housing;
- wherein the stopper has various sized wire slots so that the different diameters of the cable or the cable-like structure can be gripped inside the top cover and the bottom cover;
- wherein the additional adjustable cable coiling tool, comprising:
  - at least one first moveable member;
  - at least one second moveable member;
  - at least one third movable member with a bended part and an upright part;
  - at least one fourth movable member with a bended part and an upright part;
  - a spring used to movably and supportively link the first member and the second member;
  - a movable knurled thumb nut with a circular recess;
  - a movable sleeve-like locking frame with a set of scale marks and a pair of locking channels;
  - a movable elasticity bracket;
  - a pair of coiling parts;
  - a plurality of screws; and
  - a nut.

2. The device recited in claim 1, wherein the top cover and the bottom cover are fastened to the threaded top portion and the threaded bottom portion of the housing respectively;
- wherein the circular stepped protrusion is used to keep the well coiled cable or cable-like structure inside the housing;
- wherein the movable elasticity bracket is used to adjust the angles of the connected first and second members by the movable knurled thumb nut and the movable sleeve-like locking frame via the movable elasticity bracket;
- wherein the third member movably fastens with the first member;
- wherein the fourth member movably fastens with the second member; and
- wherein the bended parts maintain the upright parts and the coiling parts vertically parallel all the time.

3. A device used to release, retract, and store a cable or a cable-like structure comprising:
- a top cover;
- a bottom cover;
- a sandwiched housing;
- a movable cable coiling frame;
- a pair of stoppers; and
- a cable or a cable-like structure;
- wherein the top cover comprising:
  - a penetrative central hole;
  - a pair of inverted "L" shaped grooves;
  - a main part with a pair of recesses; and
  - a movable part with a pair of convexes;
    - wherein the movable part allows the cable or the cable with pre-existing plugs or pre-existing plug-like structures on both ends to enter the central hole;
    - wherein the movable part allows the cable-like structure or the cable-like structure with pre-existing connectors or pre-existing connector-like structures on both ends to enter the central hole;
- wherein the bottom cover comprising:
  - a penetrative central hole;
  - a main part with a pair of recesses; and
  - a movable part with a pair of convexes;
    - wherein the movable part allows the cable or the cable with pre-existing plugs or pre-existing plug-like structures on both ends to enter the central hole;
    - wherein the movable part allows the cable-like structure or the cable-like structure with pre-existing connectors or pre-existing connector-like structures on both ends to enter the central hole;
- wherein the sandwiched housing having:
  - a pair of shorter columnar bulges on the outer wall of the top portion;
  - a circular stepped protrusion on the lower portion of the inner wall;
- wherein the movable cable or cable-like structure coiling frame having various sized wire slots on the top and the bottom ends.

4. The device recited in claim 3, wherein the pair of convex structures are inlaid into the pair of recesses respectively such that the main part and the movable part form an integrated top cover and bottom cover via the jointed convex structures and recesses;
- wherein one of the at least one of the pair of inverted "L" grooves is on the main part; and
  - one of the at least one of the pair of inverted "L" grooves is on the movable part;
- wherein the top cover is interlocked with the housing via the inverted "L" shaped grooves matched with the pair of shorter columnar bulges on the outer wall of the top portion of the housing;
- wherein the pair of stoppers grip the cable or the cable-like structure inside the top cover and the bottom cover respectively.

5. A device used to release, retract, and store a cable or a cable-like structure comprising:
- a top cover;
- a bottom cover;
- a housing with different colors, the housing is used to hold a lock means and a rotatably releasing, retracting, and storing means;

at least one lock means, the lock means controls a cable or a cable-like structure to move in or out from the device or keep the cable or the cable-like structure to stay in a stationary state;

at least one rotatably releasing, retracting, and storing means, the rotatably releasing, retracting, and storing means can rotatably release and retract the cable or the cable-like structure from or into the device in two directions according to the pulling force or the turning force;

at least one floating flange bearing structure, the floating flange bearing structure consists of the parts from the housing and the rotatably releasing, retracting, and storing means; the floating flange bearing structure enables the rotatably releasing, retracting, and storing means to rotate for releasing and retracting the cable or the cable-like structure;

at least one manually releasing and retracting means, the manually releasing and retracting means is a hand-turning means to retract the cable or the cable-like structure into the device; or at least one manually and automatically releasing and retracting means, the manually and automatically releasing and retracting means can manually and automatically retract the cable or the cable-like structure into the device;

a cable or a cable-like structure; and a set of marks;

wherein the top cover and the bottom cover having:

a threaded inner wall;

a central penetrative hole;

wherein the top cover and the bottom cover allow the cable or the cable with one pre-existing plug or pre-existing plug-like structure to pass through the central hole;

wherein the top cover and the bottom cover allow the cable-like structure or the cable-like structure with one pre-existing connector or one pre-existing connector-like structure to pass through the central hole; or wherein the top cover comprising:

a penetrative central hole and a hole on the side wall;

a movable hanging ring;

a pair of inverted "L" shaped grooves;

a main part; and a movable part;

wherein the movable part allows the cable or the cable with pre-existing plugs or plug-like structures on both ends to enter to the central hole;

wherein the movable part allows the cable-like structure or the cable-like structure with pre-existing connectors or connector-like structures on both ends to enter the central hole;

wherein the bottom cover comprising:

a penetrative central hole;

a main part with a pair of recesses;

a movable part with a pair of convexes; and a tubular structure with two forty-five degree convex structures;

wherein the movable part allows the cable or the cable with pre-existing plugs or plug-like structures on one end or both ends to enter the central hole;

wherein the movable part allows the cable-like structure or the cable-like structure with pre-existing connectors or connector-like structures on one end or both ends to enter the central hole;

wherein the housing comprising:

at least one vertical directing groove on the inner wall;

a plurality of convex structures on the top portion of the inner wall;

a movable ring;

a pair of short columnar bulges;

a circular stepped protrusion on the inner wall of the lower portion with a circular recess;

a foldable post; and a hole;

wherein the movable ring is movably to pivot onto the circular recess of circular stepped protrusion;

wherein the pair of short columnar bulges are used to interlock with the top cover via the inverted "L" shaped grooves;

wherein the lock means comprising:

at least one first spring, wherein the first spring having a plurality of holes and a channel;

at least one second spring;

a pushing button links with the first rigid bar which is movably and vertically attached to at least one second rigid bar;

at least one adjustable nut; and a plurality of rotatable directing bars;

wherein the rotatably releasing, retracting, and storing means comprising:

a vertically movable threaded regulator with a plurality of rotatable directing bars;

a rod with a helix groove;

a movable stopper;

a flange having a circular recess on the bottom side, a channel, and a plurality of threaded holes;

a tubular structure with a channel;

wherein the floating flange bearing structure comprising:

a circular recess on the circular stepped protrusion on the inner wall of the lower portion of the housing;

a circular recess on the bottom side of the flange in the rotatably releasing, retracting, and storing means; and a sandwiched movable ring;

wherein the manually releasing and retracting means fastens directly with the flange in the rotatably releasing, retracting, and storing means to lock the floating flange bearing structures and ensure that the formed floating flange bearing structures rotate correctly in two directions for the cable or the cable-like structure releasing or retracting comprising:

a case;

a pair of convexes on the inner wall of the case;

a plurality of threaded holes on the case; or wherein the manually releasing and retracting means comprising:

a case;

a pair of convexes on the inner wall of the case;

a plurality of threaded holes on the case;

at least one first flange;

at least one second flange; and at least one spring.

6. The device recited in claim 5, wherein the top cover is interlocked with the housing via a pair of inverted "L" shaped grooves matching with the pair of shorter columnar bulges on the top outer wall of the housing;

wherein one of the pair of inverted "L" shaped grooves is on the main part and one of the pair of inverted "L" shaped grooves is on the movable part;

wherein the main part of the top cover and the bottom cover having a pair of recesses on both edges of side upright wall; and wherein the pair of convex structures are inlaid into the pair of recesses, respectively, such that the main part and the movable part form the integrated top cover and bottom cover.

7. The device recited in claim 5, wherein the plurality of holes on the first spring of the lock means, including:

at least one penetrative central hole on the bottom of the first spring; and a plurality of penetrative holes surrounding the central hole;

wherein the one of at least one of the plurality of rotatable directing bars, comprising:

a threaded bar;

a rotatable sleeve; and a nut;

wherein the plurality of rotatable directing bars are fastened with the plurality of holes surrounding the central hole.

8. The device recited in claim 5, wherein the vertically movable threaded regulator has a threaded inner wall, at least one concave structure and at least one convex structure on the outer side wall;

wherein one of the at least one of the pluralities of rotatable directing bars on the vertically movable threaded regulator, comprising: a threaded bar; a rotatable sleeve; and a nut;

wherein the plurality of rotatable directing bars on the vertically movable threaded regulator, including:

one of the at least one rotatable directing bars is the first rotatable directing bar;

one of the at least one rotatable directing bars is the second rotatable directing bar;

wherein the first and the second rotatable directing bars are parallelly and vertically fixed inside of the concave structure on the vertically movable threaded regulator;

one of the at least one rotatable directing bars is the third rotatable directing bar;

one of the at least one rotatable directing bars is the fourth rotatable directing bars;

wherein the third and the fourth rotatable directing bars are fastened on the surface of the outer wall of the vertically movable threaded regulator to forcely regulate the cable or the cable-like structure to orderly enter or move out from the helix groove on the rod;

wherein the rod with helix shallow groove on the outer wall is used to house the cable or cable-like structure, and further used to screw with the vertically movable threaded regulator, such that the vertically movable threaded regulator can merely move up and down along the helix groove vertically;

wherein the rod further comprising:

a notch on the bottom end used to house the movable stopper;

a pair of threaded holes on the end of the rod;

wherein the stopper has various sized wire slots used to ensure different diameters of the cables or the cable-like structures that are firmly fixed within the notch;

wherein the flange with the plurality of holes, including:

a threaded central hole;

at least one first pair of threaded holes;

at least one second pair of threaded holes; and at least one third pair of threaded holes;

wherein the threaded central hole is used to fasten with the movable tubular structure;

wherein the first pair of threaded holes align with the pair of the threaded holes on the rod so that both the flange and the rod are fastened together by screws;

wherein the second pair of threaded holes align with the pair of threaded holes on the pair of convexes on the case of the manually releasing and retracting means so that the flange can fasten with the manually releasing and retracting means together by screws; or wherein the second pair of threaded holes align and fasten with the pair of the threaded holes on the pair of convexes of the case and the pair of the threaded holes on the second flange of the manually and automatically releasing and retracting means;

wherein the third pair of threaded holes are used to fasten with the pair of holes on the first flange of the manually and automatically releasing and retracting means by screws;

wherein the channel on the flange is penetrably linked with the central hole so that the cable or the cable-like structure can reach the central hole via the channel;

wherein the movable tubular structure having a threaded top end used to fasten with the threaded central hole of the flange.

9. The device recited in claim 5, wherein the vertical groove on the inner wall of the housing is used to house the convex structure on the sidewall of the vertically movable threaded regulator such that the vertically movable threaded regulator is capable of vertically moving up and down along the groove on the inner wall of the housing;

wherein the plurality convex structures on the inner wall are used to support the lock means;

wherein the pair of shorter columnar bulges on the outer wall of the housing is used to interlock the top cover via the inverted "L" shaped grooves with the housing.

10. The device recited in claim 5, wherein the case of the manually releasing and retracting means is fastened with the flange of the rotatably releasing, retracting, and storing means via the threaded holes of the pair of convexes on the side wall of the manually releasing and retracting means case by screws to keep the formed floating flange bearing structure together;

wherein the pair of threaded holes on the pair of convex structures and the pair of threaded holes on the outer edge of the end portion of the case align and fasten with the second pair of threaded holes on the flange in the rotatably releasing, retracting, and storing means.

11. The device recited in claim 5, wherein the plurality of threaded holes on the case of the manually and automatically releasing and retracting means, including:

at least one threaded hole on the end of the threaded portion of the case;

at least two threaded holes on the outer edge of the end portion;

wherein the first flange having a central penetrative hole, a pair of threaded holes and a channel linked with the central hole, wherein the first flange is used to protect the spring;

wherein the second flange having a central penetrative hole, a pair of thread holes and a channel linked with the central hole, wherein the second flange is mounted on the pair of the convex structures of the case;

wherein the second flange is used to support the spring;

wherein the spring has an inner end means used to hook the tubular structure, the inner means further placed inside of the convex means of the tubular structure on the bottom cover;

wherein the spring having an outer end means used to bind with the central gap of the bolt on the bottom of the housing.

12. The device recited in claim 5, wherein the set of marks including:

numbers, from 0 to 9; or alphabetic letters, from A to Z; or combination of numbers, from 0 to 9, and alphabetic letters, from A to Z;

wherein the numbers or the alphabetic letters or the combined numbers and alphabetic letters are marked on both ends of the cable or the cable-like structure, and the device;

whereby the marks can be represented by barcode used to identify the device and the cable or the cable-like structure from multiple cables or cable-like structures and devices.

* * * * *